US008668501B2

(12) United States Patent
Esquivel et al.

(10) Patent No.: US 8,668,501 B2
(45) **Date of Patent: *Mar. 11, 2014**

(54) CONNECTOR TO FLEX ASSEMBLY

(71) Applicant: Hi Rel Connectors, Inc, Claremont, CA (US)

(72) Inventors: Derick Esquivel, Claremont, CA (US); Willis Williams, Claremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/961,756

(22) Filed: Aug. 7, 2013

(65) Prior Publication Data

US 2013/0323957 A1 Dec. 5, 2013

Related U.S. Application Data

(63) Continuation of application No. 13/398,583, filed on Feb. 16, 2012, now Pat. No. 8,529,276.

(60) Provisional application No. 61/444,681, filed on Feb. 18, 2011, provisional application No. 61/450,076, filed on Mar. 7, 2011.

(51) Int. Cl.
*H01R 12/00* (2006.01)

(52) U.S. Cl.
USPC ..... 439/67; 439/492

(58) Field of Classification Search
USPC ..... 439/67, 492
See application file for complete search history.

(56) References Cited

U.S. PATENT DOCUMENTS 8,475,181 B2 * 7/2013 Niitsu et al. ..... 439/67

* cited by examiner

*Primary Examiner* — Gary Paumen
(74) *Attorney, Agent, or Firm* — Cotman IP Law Group, PLC

(57) ABSTRACT

An electrical assembly connector for connecting a flexible assembly having a plurality of flexible assembly electrical contacts to a rigid assembly having a connector receptacle with a plurality of attachment element electrical contacts. The connector comprises an intermediary device configured to electrically connect the rigid assembly and the flexible assembly. The intermediary device has a plurality of connector electrical contacts. The intermediary device electrical contacts are exposed on a first base side and on a second base side of the intermediary device. The intermediary device electrical contacts exposed on the second base side are configured to mechanically and electrically couple to the flexible assembly electrical contacts, and the intermediary device electrical contacts exposed on the first base side are configured to electrically and mechanically couple to the attachment element electrical contacts.

20 Claims, 6 Drawing Sheets

CONNECTOR TO FLEX ASSEMBLY

CROSS-REFERENCE TO RELATED APPLICATIONS

This application is a continuation of U.S. application Ser. No. 13/398,583, filed on Feb. 16, 2012; which claims priority from U.S. Provisional Patent Application Ser. No. 61/444,681, filed Feb. 18, 2011, and claims priority from U.S. Provisional Patent Application Ser. No. 61/450,076, filed Mar. 7, 2011, specifications of which are herein incorporated by reference in their entirety.

FIELD OF THE INVENTION

The invention relates generally to electrical connection assemblies and, more particularly, to electrical connection assemblies comprising a flexible electrical conductor and a rigid assembly, such as a circuit board.

BACKGROUND OF THE INVENTION

Sophisticated electrical and electronic components are frequently disposed proximate to high vibration equipment, such as aircraft and rocket engines. Because of the narrow confines wherein such components are typically disposed, interconnecting such components often employs the use of flexible electrical conductors ("flexible assemblies").

The prior art methods of attaching a flexible assembly to a rigid assembly (such as a circuit board) usually employ some form of permanent attachment, such as methods wherein the flexible assembly is soldered to the rigid assembly.

Problems arise in such prior art methods when the attachment between the flexible assembly and the rigid assembly fails—frequently due to a high vibration environment. Such failures cannot easily (if at all) be repaired in the field, and, in most cases, require the complete replacement of both flexible assembly and rigid assembly. Such complete replacement of both assemblies is awkward, time-consuming and expensive.

Accordingly, there is a need for a method of attaching a flexible assembly to a rigid assembly which does not involve the aforementioned problems in the prior art.

SUMMARY OF THE INVENTION

The invention satisfies this need. The invention is an electrical assembly combination comprising an intermediary device for electronically connecting a flexible circuit to a standardized receptacle comprising (a) a rigid assembly having an connector attachment element with a plurality of attachment element electrical contacts; (b) a flexible assembly having a plurality of flexible assembly electrical contacts; and (c) an intermediary device electrically connected to, and disposed between, the rigid assembly and the flexible assembly, the intermediary device comprising an insulator core and a plurality of intermediary device electrical contacts, the core having a first base side and an opposed second base side, the intermediary device electrical contacts comprising a first set of intermediary device electrical contacts exposed on the first base side and a second set of intermediary device electrical contacts exposed on the second base side, each contact in the first set of intermediary device electrical contacts being electrically connected to a corresponding contact in the second set of intermediary device electrical contacts, each intermediary device electrical contact being sized and dimensioned to electrically connect with an attachment element electrical contact or with a flexible assembly electrical contact. In the invention, each of the attachment element electrical contacts is removably secured and electrically connected to the first set of intermediary device electrical contacts and each of the flexible assembly electrical contacts is removably secured and electrically connected to the second set of intermediary device electrical contacts.

The objective of the invention is to provide an electrical assembly combination with a mechanical intermediary device for electrically connecting a flexible circuit and a plurality of conductive elements found within the flexible circuit to a standardized electrical receptacle comprising a plurality of conductive elements located within the receptacle.

BRIEF DESCRIPTION OF DRAWINGS

These and other features, aspects and advantages of the present invention will become better understood with reference to the following description, appended claims and accompanying drawings where:

DETAILED DESCRIPTION OF THE INVENTION

Figure 2:
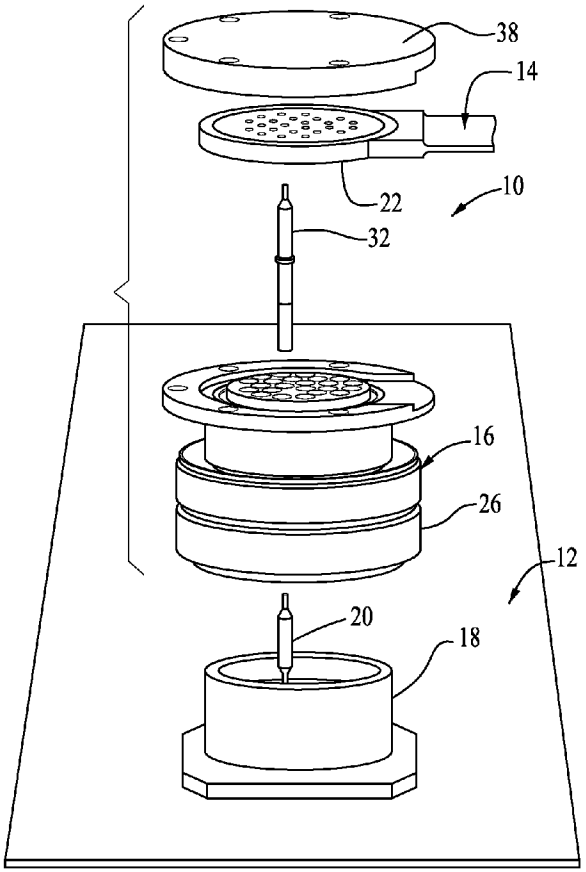
FIG. 2 is a perspective exploded view of the electrical connection assembly illustrated in FIG. 1.
Figure 1:
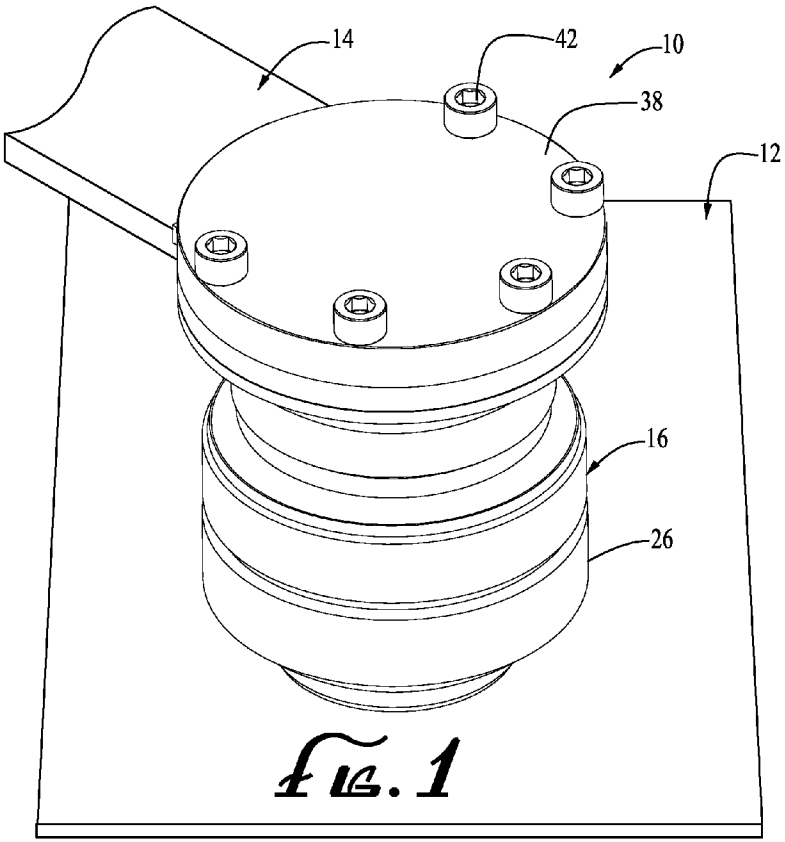
FIG. 1 is a perspective of an electrical assembly combination having features of the invention.
Figure 3:
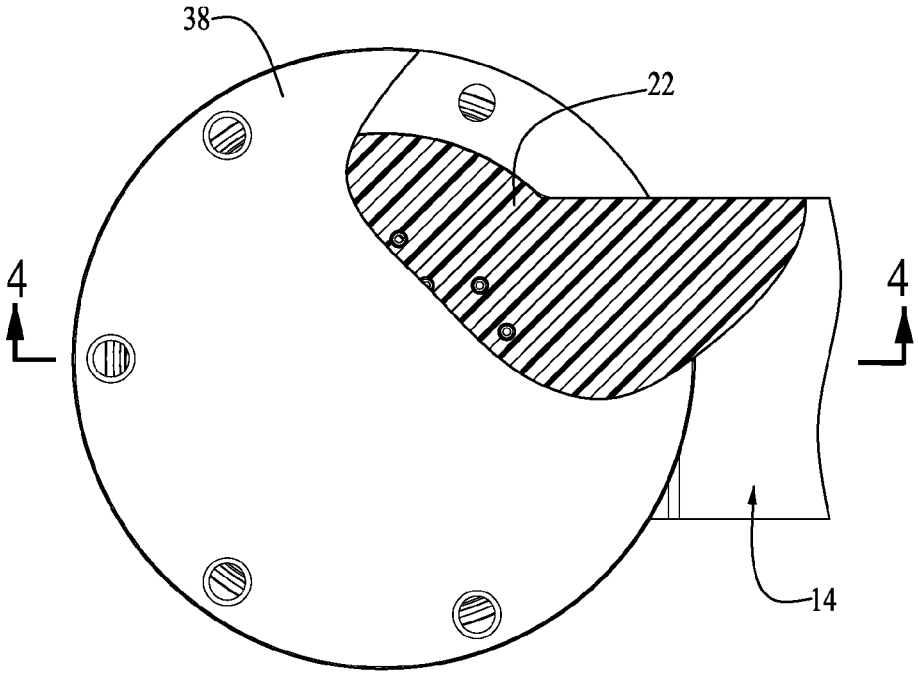
FIG. 3 is a top view in partial cross-section of the electrical assembly combination illustrated in FIG. 1.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is an electrical assembly combination 10 comprising a rigid assembly 12, a flexible assembly 14 and an intermediary device 16 disposed between the rigid assembly 12 and the flexible assembly 14.

This electrical assembly combination 10 is typically modular in its construction.

The rigid assembly 12 can be a circuit board. The rigid assembly 12 has connector attachment element (i.e. connector receptacle) 18 comprising a plurality of attachment element electrical contacts 20. The connector attachment element electrical contacts 20 can be pins or sockets for pins.

In a typical embodiment, the electrical assembly combination 10 uses a standardized mating interface between the intermediary device 16 and the connector attachment element 18. This allows the intermediary device 16 to electrically connect to a standardized receptacle connector attachment element 18 to increase the usability and acceptance of the intermediary device 16 in existing applications and infrastructures. A standardized mating interface allows the intermediary device electrical contacts 32 to electrically and mechanically engage with the attachment element electrical contacts 20, and creates a contamination barrier sufficient to meet relevant design specifications.

The flexible assembly 14 has a terminal end 22 with a plurality of flexible assembly electrical contacts 24. The flexible assembly electrical contacts 24 may also be pins or sockets for pins. The electrical assembly combination 10 can be adapted to accommodate any shape and configuration of flexible assembly terminal ends 22.

The intermediary device 16 serves as the interface between the flexible assembly 14 and the rigid assembly 12. The intermediary device 16 is physically configured to engage and disengage, in a nondestructive manner, with both the flexible assembly electrical contacts 24 and the rigid assembly electrical contacts 20 to form a mated triad of conductive elements.

Figure 6:
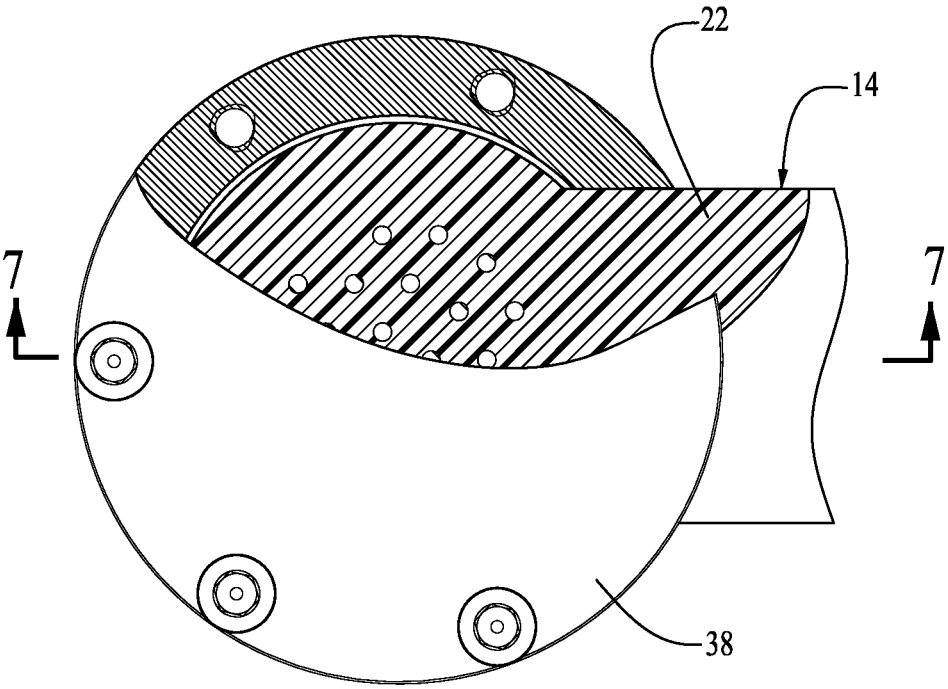
FIG. 6 is a top view, in partial cutaway, of a first alternative electrical connection assembly having features of the invention.
Figure 7:
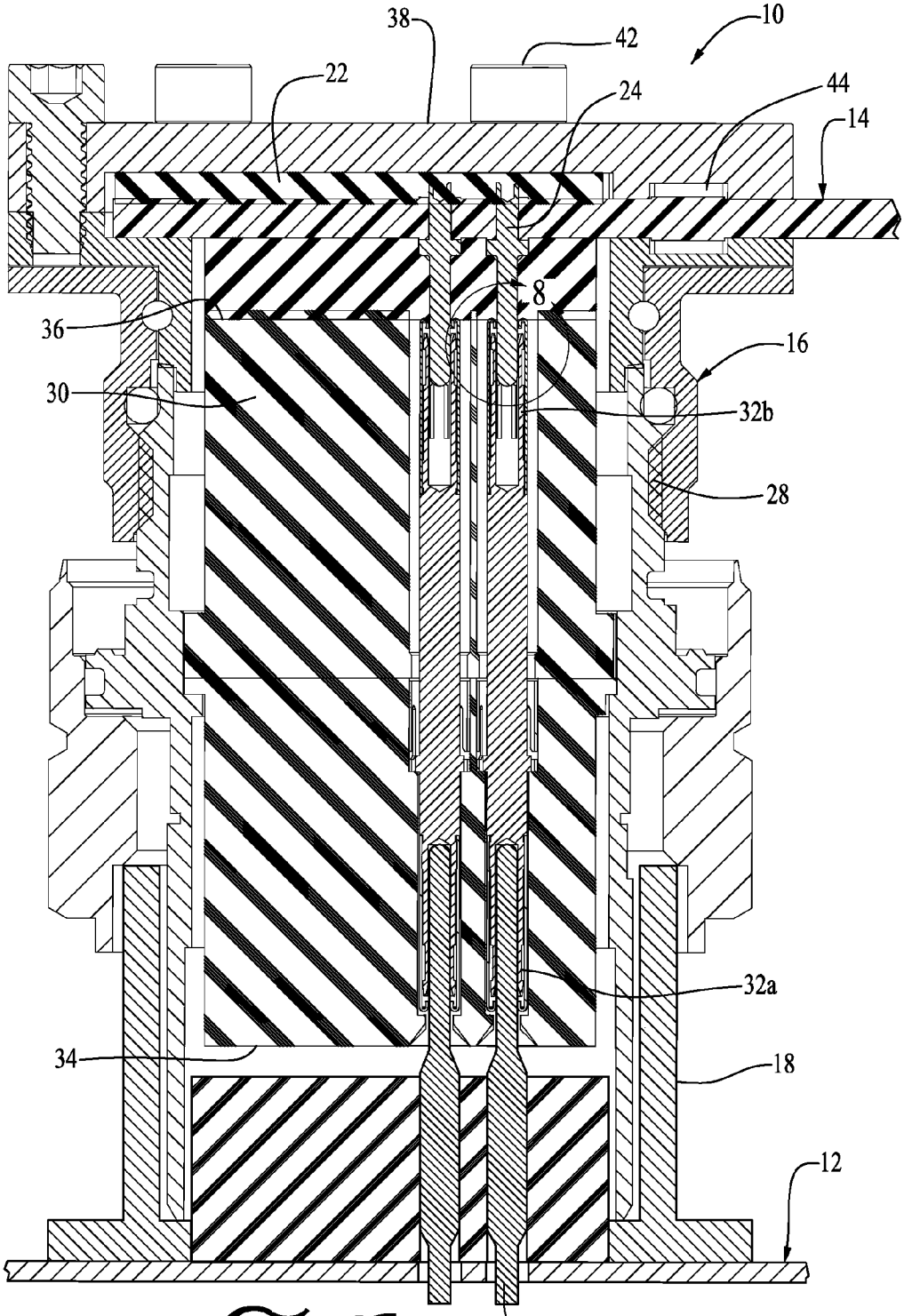
FIG. 7 is a cross-sectional side view of the first alternative electrical assembly combination illustrated in FIG. 6, taken along line 7-7 in FIG. 6.
Figure 8:
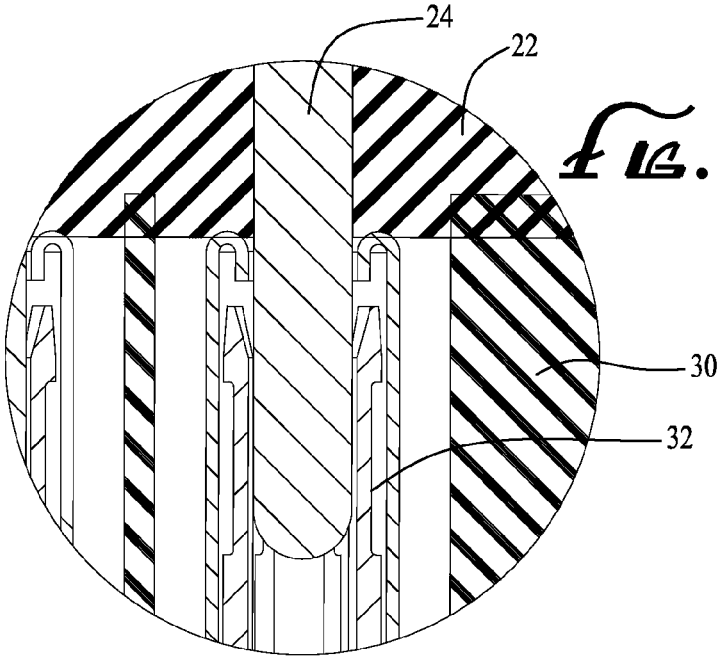
FIG. 8 is a detail view of a portion of the electrical assembly combination illustrated in FIG. 7.
Figure 9:
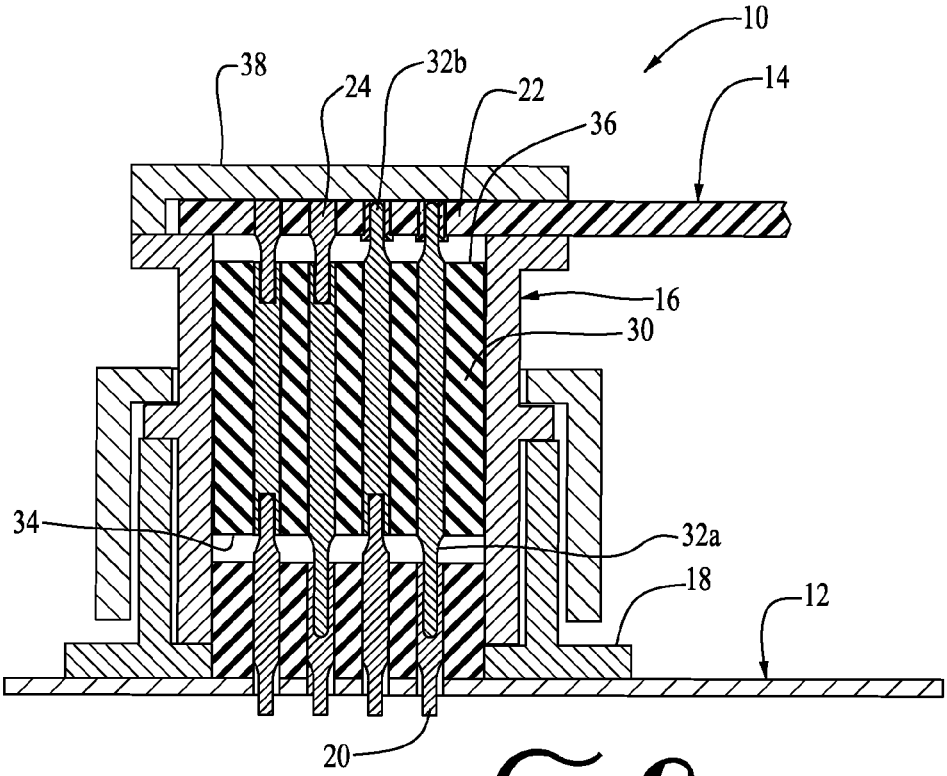
FIG. 9 is a cross-sectional side view of a second alternative electrical assembly combination having features of the invention.

FIGS. 1-5 illustrate an embodiment of the invention wherein the intermediary device 16 comprises an integral backshell 26. FIGS. 6-8 illustrate an alternative embodiment of the invention wherein the intermediary device comprises a threaded backshell 28. FIG. 9 illustrates a second simplified embodiment.

In all embodiments, the intermediary device 16 comprises an insulator core 30 and the plurality of intermediary device electrical contacts 32. The core 30 has a first base side 34 and an opposed second base side 36. The core 30 comprises an insulator through which electrical conductors are disposed to connect a first set of intermediary device electrical contacts 32*a* to a second set of intermediary device electrical contacts 32*b*. The several sets of contacts within the electrical assembly combination 10 allow the transmission of signal and power from the flexible assembly 14, through the intermediary device 16 and to the rigid assembly 12.

The intermediary device 16 can comprise a multitude of electrical contact patterns and densities, and can comprise a multitude of contact sizes for various current carrying capabilities.

The first set of intermediary device electrical contacts 32*a* are exposed on the first base side 34 and the second set of intermediary device electrical contacts 32*b* are exposed on the second base side 36. As noted above, each contact in the set of intermediary device electrical contacts 32*a* is electrically connected to a corresponding contact in the second set of intermediary device electrical contacts 32*b*. Each intermediary device electrical contact 32 is sized and dimensioned to electrically connect with an attachment element electrical contact 20 or with a flexible assembly electrical contact 24.

Each of the first set of intermediary device electrical contacts 32*a* is removably secured and electrically connected to the attachment element electrical contacts 20, and each of the second set of intermediary device electrical contacts 32*b* is removably secured and electrically connected to the flexible assembly electrical contacts 24. Thus, the intermediary device 16 electrical contacts 32 can be individually removed and replaced, preferably without the use of tools.

The several sets of contacts may be mated by various known methods, including, but not limited to, pin-socket mating, spring probes or blade-card insertion. All contacts are both serviceable and solderless.

The intermediary device 16 provides an enclosure for accepting and retaining the flexible assembly terminal end 22, such that the flexible assembly 14 may be non-destructively removed from the enclosure. The intermediary device 16 positions the flexible assembly 14 within the enclosure in a manner that allows the flexible assembly electrical contacts 24 to be exposed to the intermediary device electrical contacts 32 in order to make physical contact and become electrically interconnected with the flexible assembly electrical contacts 24 in a non-permanent form. Such non-permanent interconnection allows the flexible assembly electrical contacts 24 to become disengaged from the intermediary device electrical contacts 32 without causing damage to either the flexible assembly electrical contacts 24 or to the intermediary device electrical contacts 32.

Figure 5:
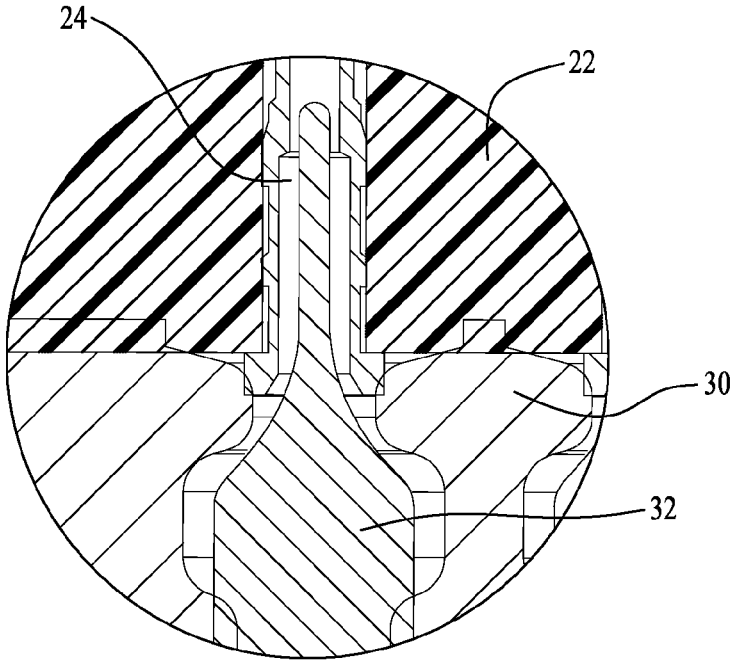
FIG. 5 is a detail view of a portion of the electrical assembly combination illustrated in FIG. 4.
Figure 4:
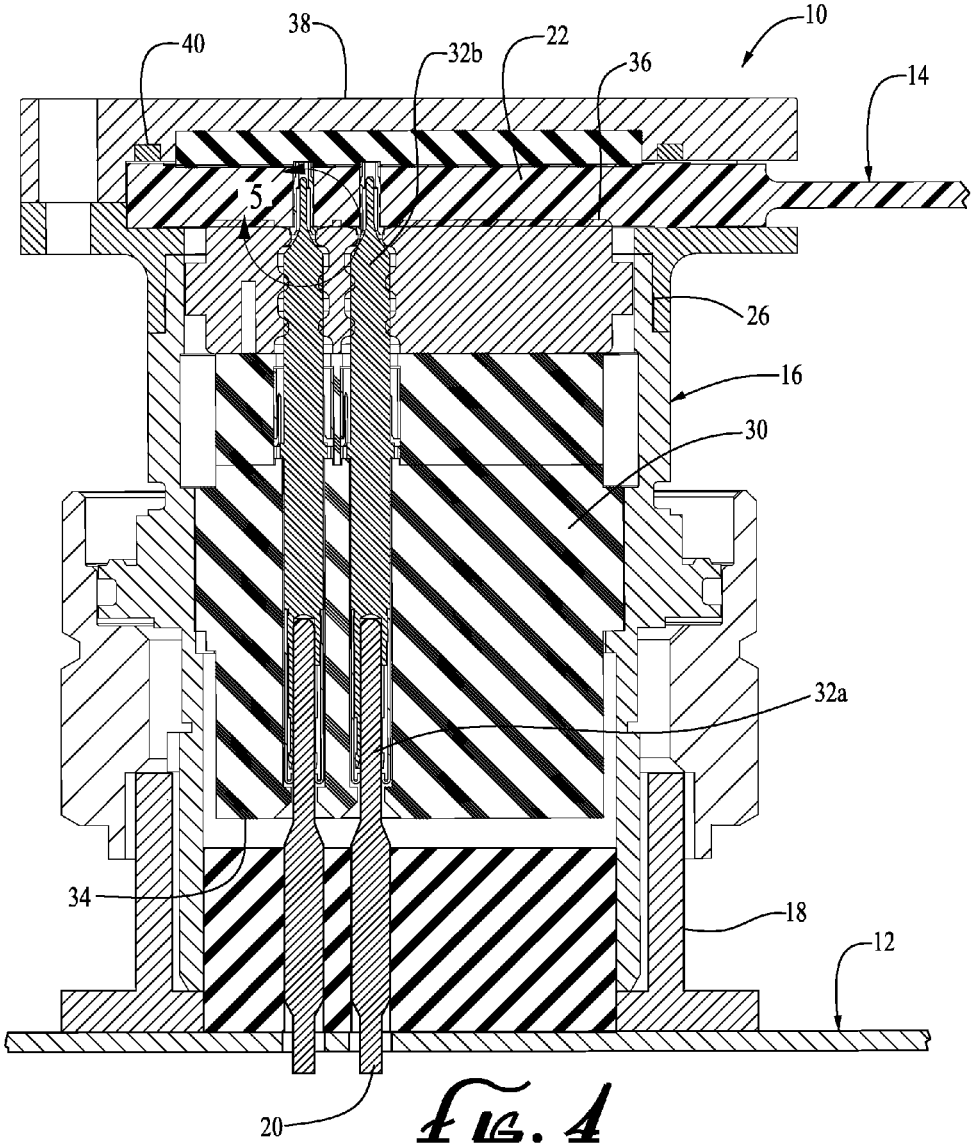
FIG. 4 is a cross-sectional side view of the electrical assembly combination illustrated in FIG. 3, taken along line 4-4.

FIGS. 5 and 8 illustrate in detail a typical contact pin disposed within a contact socket.

The backshell 26 of the intermediary device 16 can be made from a multitude of materials, including but not limited to the following: aluminum, titanium, steel, plastic, PEEK, as well as composites (conductive or non-conductive).

The cross-sectional shape of the intermediate device 16 can be circular, rectangular, as well as other shapes. The intermediary device 16 can have multiple entry locations for a plurality of flexible assemblies 14.

The intermediary device 16 can further comprise active and passive accessories and components, such as signal filters, signal indicators and power regulators.

The intermediary device 16 can be provided by a standard electrical connector such as Model 86010F-17-35PN, marketed by Hi Rel Connectors of Claremont, Calif.

In the embodiment illustrated in FIGS. 1-5, the integral backshell 26 is capped on one end by a backshell cap 38. Sealing the backshell cap 38 to the backshell 26 is a gasket 40.

The cap 38 serves the purpose of enclosing and sealing the connector/flex assembly and provide environmental/EMI, EMC protection. It can be used as a structural member and support for a flex harness assembly as well as a vibration dampening feature. The cap 38 can be made to work with various mechanical retention features such as but not limited to bolts 42, threaded studs and captive screws. The intermediary device cap 38 can be made from a variety of materials such as but not limited to, aluminum, titanium, steel, composites (conductive and non-conductive).

A grommet 44 is typically disposed around the flexible assembly 14 to provide environmentally sealed flexible assembly 14 entry.

The gaskets 40 and grommets 44 provide a seal to protect the space between the intermediary device 16 and the flexible assembly 14 sufficient to prevent contamination from foreign entities. Such physical seal acts in a manner that prevents any undesirable foreign entities from entering the engagement area between the flexible assembly electrical contacts 24 and the intermediary device electrical contacts 32.

The use of gaskets 40 and grommets 44 can also be incorporated into the assembly to serve an array of functions, such as, but not limited to, environmental sealing, EMI/EMC bonding, vibration dampening and air volume reduction.

As stated above, FIGS. 6-8 illustrate an embodiment of the invention 10 wherein the intermediary device 16 comprises a threaded coupling ring 28. The drawings indicate how a backshell coupling ring 28 can be used in the backshell 26.

The electrical assembly combination 10 of the invention can also provide an interlocking function between for the intermediary device 16, the flexible assembly 14 and the rigid assembly 12, which, upon full engagement of the interlocking mechanism, further seals the intermediary device 16 enclosure to assist in the prevention of foreign contamination entering the mating interface between the flexible assembly 14 and the intermediary device 16.

The electrical assembly combination 10 facilitates the installation and replacement of a flexible assembly 14 to a rigid assembly 12 without the use of solder or other permanent connection. Furthermore, the electrical assembly combination 10 of the invention provides assurance that the flexible assembly 14 and the intermediary device 16 do not become disengaged during operation of the apparatus in environments that would otherwise cause disengagement, thereby making the electrical assembly combination 10 useful in extreme environments. The several sets of mated electrical contacts may be individually disconnected from each other at either mating interface without causing damages to any of the contacts, and any contact may be removed from its respective retention feature without causing damages to the contact or retention feature or housing.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. An electrical connector assembly comprising:

a housing comprising an exposed first base end and an exposed second base end, said housing configured to couple with a flexible assembly terminal at said second base end, wherein said flexible assembly terminal comprises a plurality of flexible assembly electrical contacts, and wherein said first base end comprises a first base connector configured to couple to a connector receptacle on a rigid assembly, said connector receptacle comprising a plurality of attachment element electrical contacts;

an insulator core inside said housing, said insulator core having a first end exposed on said first base end and a second end exposed on said second base end;

a first plurality of intermediary device electrical contacts coupled to said insulator core and exposed on said first end of said first base end, wherein each one of said first plurality of intermediary device electrical contacts is configured to removably couple and electrically connect to a corresponding one of the plurality of attachment element electrical contacts when said first base connector is coupled to said connector receptacle on said rigid assembly;

a second plurality of intermediary device electrical contacts coupled to said insulator core and exposed on the second base end, wherein each one of the second plurality of intermediary device electrical contacts is configured to removably couple and electrically connect to a corresponding one of the plurality of flexible assembly electrical contacts when said flexible assembly terminal is coupled to said housing, wherein each one of said first plurality of intermediary device electrical contacts is electrically connected through said insulator core to a corresponding one of said second plurality of intermediary device electrical contacts; and a cap configured to couple to said housing and seal said flexible assembly terminal on said second base end.

2. The electrical connector assembly of claim 1, wherein the rigid assembly is a circuit board.

3. The electrical connector assembly of claim 1, wherein at least a subset of said first and second plurality of intermediary device electrical contacts are pins.

4. The electrical connector assembly of claim 1, wherein a flexible assembly electrical contact of said plurality of flexible assembly electrical contacts is a socket when a corresponding one of said plurality of second plurality of intermediary device electrical contacts is a pin, and said flexible assembly electrical contact of said plurality of flexible assembly electrical contacts is a pin when said corresponding one of said second plurality of intermediary device electrical contacts is a socket.

5. The electrical connector assembly of claim 1, wherein the housing further comprises one or more screw holes.

6. The electrical connector assembly of claim 5, wherein each one of said first plurality of intermediary device electrical contacts and a corresponding one of said second plurality of intermediary device electrical contacts are opposite ends of an electrical contact element.

7. The electrical connector assembly of claim 6, wherein said connector receptacle comprises a standardized mating interface allowing the first plurality of intermediary device electrical contacts to electrically and mechanically engage with the plurality of attachment element electrical contacts thereby creating a contamination barrier.

8. The electrical connector assembly of claim 1, wherein said cap further comprises a gasket to seal said flexible assembly terminal within said housing.

9. The electrical connector assembly of claim 1, wherein an attachment element electrical contact of said plurality of attachment element electrical contacts is a socket when a corresponding one of said plurality of first plurality of intermediary device electrical contacts is a pin, and said attachment element electrical contact of said plurality of attachment element electrical contacts is a pin when said corresponding one of said first plurality of intermediary device electrical contacts is a socket.

10. The electrical connector assembly of claim 1, wherein said cap further comprises one or more mechanical retention elements for removably securing said cap to said second base end of said housing.

11. An electrical connector assembly comprising:

a housing comprising an exposed first base end and an exposed second base end, said housing configured to couple with a flexible assembly terminal at said second base end, wherein said flexible assembly terminal comprises a plurality of flexible assembly electrical contacts, and wherein said first base end comprises a first base connector configured to couple to a connector receptacle on a rigid assembly, said connector receptacle comprising a plurality of attachment element electrical contacts;

an insulator core inside said housing, said insulator core having a first end exposed on said first base end and a second end exposed on said second base end;

a first plurality of intermediary device electrical contacts coupled to said insulator core and exposed on said first end of said first base end, wherein each one of said first plurality of intermediary device electrical contacts is configured to removably couple and electrically connect to a corresponding one of the plurality of attachment element electrical contacts when said first base connector is coupled to said connector receptacle on said rigid assembly; and a second plurality of intermediary device electrical contacts coupled to said insulator core and exposed on the second base end, wherein each one of the second plurality of intermediary device electrical contacts is configured to removably couple and electrically connect to a corresponding one of the plurality of flexible assembly electrical contacts when said flexible assembly terminal is coupled to said housing, wherein each one of said first plurality of intermediary device electrical contacts is electrically connected through said insulator core to a corresponding one of said second plurality of intermediary device electrical contacts.

12. The electrical connector assembly of claim 11, wherein the plurality of attachment element electrical contacts are pins.

13. The electrical connector assembly of claim 12, wherein said connector receptacle comprises a standardized mating interface allowing the first plurality of intermediary device electrical contacts to electrically and mechanically engage with the plurality of attachment element electrical contacts thereby creating a contamination barrier.

14. The electrical connector assembly of claim 11, further comprising a cap with one or more mechanical retention elements for removably securing said cap to said second base end of said housing.

15. The electrical connector assembly of claim 14, further comprising a gasket between said cap and said flexible assembly terminal to seal said flexible assembly terminal within said housing.

16. The electrical connector assembly of claim 11, wherein each one of said first plurality of intermediary device electrical contacts and a corresponding one of said second plurality of intermediary device electrical contacts are opposite ends of a replaceable electrical contact element.

17. The electrical connector assembly of claim 11, wherein a flexible assembly electrical contact of said plurality of flexible assembly electrical contacts is a socket when a corresponding one of said plurality of second plurality of intermediary device electrical contacts is a pin, and said flexible assembly electrical contact of said plurality of flexible assembly electrical contacts is a pin when said corresponding one of said second plurality of intermediary device electrical contacts is a socket.

18. The electrical connector assembly of claim 11, wherein an attachment element electrical contact of said plurality of attachment element electrical contacts is a socket when a corresponding one of said plurality of first plurality of intermediary device electrical contacts is a pin, and said attachment element electrical contact of said plurality of attachment element electrical contacts is a pin when said corresponding one of said first plurality of intermediary device electrical contacts is a socket.

19. An electrical connector assembly comprising:

a housing comprising an exposed first base end and an exposed second base end, said housing configured to couple with a flexible assembly terminal at said second base end, wherein said flexible assembly terminal comprises a plurality of flexible assembly electrical contacts, and wherein said first base end comprises a first base connector configured to couple to a connector receptacle on a rigid assembly, said connector receptacle comprising a plurality of attachment element electrical contacts;

a first plurality of intermediary device electrical contacts inside said housing and exposed on said first base end, wherein each one of said first plurality of intermediary device electrical contacts is configured to removably couple and electrically connect to a corresponding one of the plurality of attachment element electrical contacts when said first base connector is coupled to said connector receptacle on said rigid assembly; and a second plurality of intermediary device electrical contacts inside said housing exposed on the second base end, wherein each one of the second plurality of intermediary device electrical contacts is configured to removably couple and electrically connect to a corresponding one of the plurality of flexible assembly electrical contacts when said flexible assembly terminal is coupled to said housing, wherein each one of said first plurality of intermediary device electrical contacts is electrically connected through said insulator core to a corresponding one of said second plurality of intermediary device electrical contacts.

20. The electrical connector assembly of claim 19, further comprising a cap with one or more mechanical retention elements for removably securing said cap to said second base end of said housing.

* * * * *